United States Patent [19]

Cox

[11] Patent Number: 4,804,217

[45] Date of Patent: Feb. 14, 1989

[54] ANTI-THEFT LOCKING DEVICE

[76] Inventor: Joseph A. Cox, 41 Orlando Road, New South Wales, Australia, 2299

[21] Appl. No.: 49,695

[22] PCT Filed: Jun. 23, 1986

[86] PCT No.: PCT/AU86/00179

§ 371 Date: Apr. 15, 1987

§ 102(e) Date: Apr. 15, 1987

[87] PCT Pub. No.: WO86/07621

PCT Pub. Date: Dec. 31, 1986

[30] Foreign Application Priority Data

Jun. 23, 1985 [AU] Australia ..... PH1137

[51] Int. Cl.[4] ..... E05C 21/02

[52] U.S. Cl. ..... 292/347; 292/336.3

[58] Field of Search ..... 70/181; 292/1, 336.3, 292/347, DIG. 63

[56] References Cited

U.S. PATENT DOCUMENTS

| | | | |
|---|---|---|---|
| 2,865,667 | 12/1958 | Schlage | 292/336.3 X |
| 3,206,956 | 9/1965 | Trammell, Jr. | 70/181 |
| 3,247,691 | 4/1966 | Martin | 70/181 |
| 3,451,164 | 6/1969 | Kappelman | 49/35 |
| 3,623,758 | 11/1971 | Trinca | 292/347 |
| 3,999,788 | 12/1976 | Livingston | 292/347 |
| 4,169,620 | 10/1979 | Pacura | 292/347 |

FOREIGN PATENT DOCUMENTS

| | | |
|---|---|---|
| 50982 | 8/1969 | Australia . |
| 46087 | 3/1974 | Australia . |
| 2369404 | 5/1978 | France . |

*Primary Examiner*—Richard E. Moore

*Attorney, Agent, or Firm*—Christie, Parker & Hale

[57] ABSTRACT

A security device fits to a door frame or sill and operates between a locked and unlocked position so that the door can be locked and unlocked. The device comprises a first sleeve fixedly and non-rotatably attached to the door frame or sill, and a second sleeve which fits concentrically and rotatably within the first sleeve. The device also comprises a spindle which fits concentrically and rotatably within both the first and second sleeves and which is operably connected with a locking component on or within the door. When the device is to bet set in the locked position, the second sleeve is pushed downwardly and rotatably within the first sleeve against a bias located within the first sleeve against a bias located within the first sleeve such that the second sleeve releasably engages the first sleeve via engaging means and the spindle is pushed downwardly so that the locking component locks the door. When the device is to be set in the unlocked position, the second sleeve is first pushed downwardly and then is rotated such that the engaging means disengages from the first sleeve. The bias forces the second sleeve is an upward direction such that it engages the spindle to force the spindle upwards, thereby causing the locking component to be placed in an unlocked mode.

10 Claims, 3 Drawing Sheets

ANTI-THEFT LOCKING DEVICE

The present invention relates to anti-theft devices for motor vehicles, in particular such devices for addition to or replacement of existing security systems in said motor vehicles.

A great number of motor vehicles at present on the world's roads utilise a locking spindle and knob on the top sill of a doorway. It has been found that many thieves, by use of wire or package strapping and the like, can still gain access to the interior of a motor vehicle via these locking spindles and knobs.

It is an object of the present invention to provide a security device which substantially overcomes or ameliorates the disadvantages of locking devices on existing or new vehicles.

According to one aspect of the present invention there is disclosed a security device comprising:

(a) a relatively stationary sleeve member; and (b) a spindle member; wherein said spindle member is adapted to releasably engage said sleeve member; said sleeve member adapted to engage a door frame of an existing motor vehicle, whilst said spindle member is adapted to replace a conventional spindle member.

According to a further aspect of the present invention there is disclosed a security device comprising:

(a) a relatively stationary sleeve member;

(b) a spindle member; and (c) a rotatable sleeve member;

wherein said relatively stationary sleeve member engages a door frame or sill; said rotatable sleeve member adapted to fit into said relatively stationary sleeve member; said spindle member adapted to replace a conventional spindle; wherein said rotatable sleeve member is rotatable and lockable in said relatively stationary sleeve member whereby said spindle member when in a locked position, does not protrude over an upper rim of said rotating sleeve.

Another feature of the present invention is a security device comprising members having tapered surfaces which taper inwardly as the member extends upwardly and one of said members being a spindle member or rotatable sleeve which is locked in a second of said members being a relatively stationary sleeve member by firstly pushing said spindle member or said rotatable sleeve downwards against a bias then rotating same allowing said spindle member or rotatable sleeve to be moved in the direction of said bias to come to a locked rest position. This means to unlock this rotatable sleeve requires a positive downward motion to counteract the bias or spring then rotation of the rotatable sleeve will pop upwards by virtue of the bias or spring.

In its broadest form the present invention comprises a security device comprising:

(a) a first sleeve member;

(b) a spindle member; and (c) a second sleeve member;

wherein when fitted to a door frame or sill, the first sleeve member non rotatably engages said door frame or sill;

said second sleeve member being adapted to rotatably fit into said first sleeve member;

wherein said second sleeve member is rotatable and lockable in said first sleeve member and said spindle member is slidably located within said second sleeve member such that when the spindle is in its lower position, it does not substantially protrude above said second member.

In an alternative form of the invention the locking device comprises a security device comprising:

a first sleeve member and a spindle member wherein when fitted to a door frame or sill said first sleeve member non rotatably engages the said door frame or sill;

said spindle member being adapted to fit into said first sleeve member;

wherein said spindle is rotatable and lockable against rotation and substantial longitudinal motion in said first sleeve member such that the spindle when in any position of engagement with said first sleeve member protrudes above said sleeve member.

The present invention is useful not only for the purpose of anti-theft devices but also for child safety.

An embodiment of the present invention will now be described, by way of example only, with references to the accompanying drawings in which.

Figure 1:
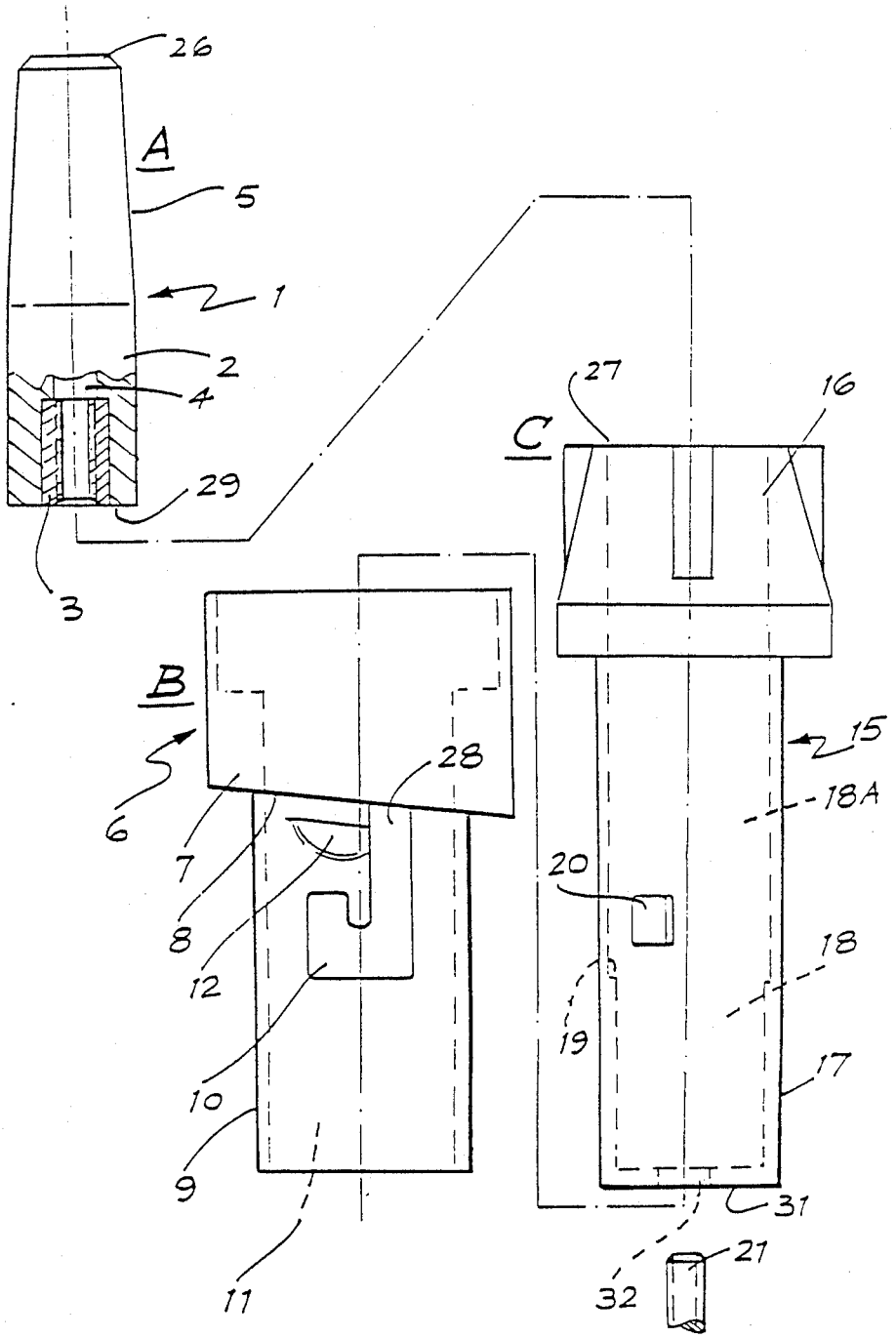
FIG. 1 illustrates a first locking means according to the present invention and comprised of components A, B and C.
Figure 4:
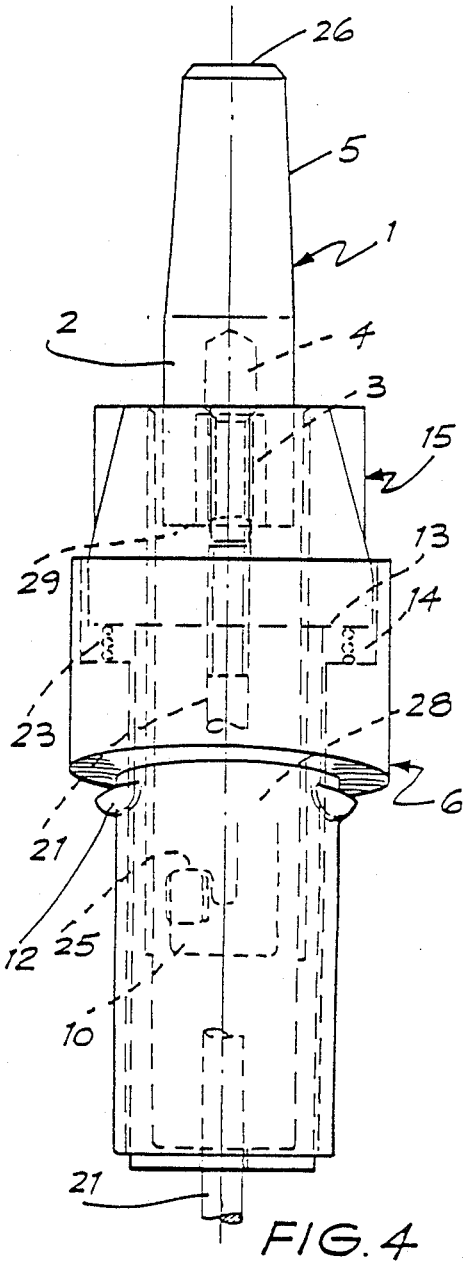
FIG. 4 illustrates the components of FIG. 1 in assembled condition on an in place locking spindle.

As illustrated in FIGS. 1 and 4, a security device comprises a door lock spindle 1 having a downwardly extending shaft 2 having a hollow portion 4 therewithin adapted to receive a threaded insert 3. The upper end of the spindle 1 having inwardly tapering surfaces 5.

A relatively stationary outer sleeve 6 has a tapering flange portion 7 and includes an angled surface 8 for fitting against the sill surface of a car door. Downwardly extending tail portion 9 is placed in position through a car door. On internal surfaces of the outer sleeve 6 there are located a slot 10 and in the view of FIG. 1 component B this is seen as being "J" shaped. There is also located a hollow central portion 11 through which a downwardly extending tail portion 17 of inner sleeve 15 passes. A tab 12 (also called a locking lug) is to keep the sleeve firmly located within a car door skin on a car door sill.

Illustrated in FIG. 1 component C is inner sleeve 15 comprising at an upward end a tapering portion 16, a downwardly extending tail 17 through which a bore 18 is located. The bore 18 is counter bored at 18A to provide a shoulder 19. On the exterior of the tail portion 17 are located spigots 20 adapted to run in the "J" slot 10 in the outer sleeve of FIG. 1 component B.

In the lower portions of the inner sleeve 15 there is a cap or closed and portion 31 having a bore 32 being substantially equal to the width or diameter of the locking rod 21. This will prevent rods being inserted up the tail 17 of the inner sleeve 15 to lift spindle 1 directly which would obviate the use of a key in the conventional door lock.

The assembly drawing of FIG. 4, illustrates the apparatus of FIG. 1. The door lock rod 21 engages the threaded insert 3 in the hollow 4 on the tail piece 2 of spindle 1. For attaching the spindle 1 to the door lock rod 21 the outer sleeve 6 is first located into a car door panel or sill and the design of the outer sleeve 6 is such that the distance between the locking lug 12 and the tapered surface 8 approximates the thickness of the door sill. This way, the outer sleeve 6 is held firmly in the door.

Then, the inner sleeve 15 is located in the outer sleeve 6. Inner sleeve 15 seats on biasing spring 23. Shoulder 13 of inner sleeve 15 comes in contact with the biasing spring 23 which is housed within cavity 14 of outer sleeve 6.

The inner sleeve 15 is located and guided in the outer sleeve 6 by means of the spigots 20 which move in the "J" slot 10 between the inner and outer sleeves (15, 6). The small compression spring 23 is located to provide spring bias. Once the inner and outer sleeves 15 and 6 respectively have been located within each other and located in the door, the spindle 1 is then screwed on to the locking rod 21 completing the assembly.

In use, the door lock of FIG. 4 operates as follows. When door lock spindle 1 is pushed down it locks the door using the conventional door lock rod and mechanism already installed by pushing the locking rod 21 in the downward direction. Before pushing the spindle 1 down, however, the inner sleeve 15 is locked into the outer sleeve 6 by pushing the inner sleeve 15 downwards so that the spigots 20 move downwardly in the "J" slot 10. It must be noted that there are two "J" slots 10 and two spigots 20 preferably spaced at the further distance from each other around the circumference of tail 17. This downward motion pushes against the bias of spring 23 and once the maximum downward portion has been reached, rotation in a clockwise direction will move the spigot 20 across the horizontal portion of the "J" and upon reaching the furthest point in a clockwise direction, and then releasing the inner sleeve 15, the inner sleeve 15 by virtue of the spring bias from spring 23 will move upwardly into the tail end 25 of the "J" slot 10. In this position the outer sleeve 6 and the inner sleeve 15 are locked relative to each other. To then lock the door, spindle 1 is pushed down as previously described.

In the locked position, the spindle 1, and more specifically the top 26 thereof is located beneath a rim 27 of the spindle 15. To unlock the door from the inside of the vehicle the inner sleeve 15 is pushed down and then rotated in an anti-clockwise direction so that the spigot 20 engages the beginnings 28 of the "J" slot 10 and the spring 23 then pushes the inner sleeve 15 in the upward direction. As the lower shoulder 29 on the spindle 1 engages shoulder 19 in the inner sleeve, movement of inner sleeve 15 also moves the spindle 1 and consequently the door lock rod 21 is moved to the upward position thereby unlocking the door.

When unlocking the door from the outside a key must be inserted into the conventional door lock which then moves the spindle upwardly, however, the outer sleeve remains in and locked to the inner sleeve when this done. To prevent unauthorized entry and to aid in this authorized entry a locking mechanism guard 30 (see FIG. 5) is placed in the driver's side door locking mechanism to prevent wire and the like being used to open the door lock.

Figure 2:
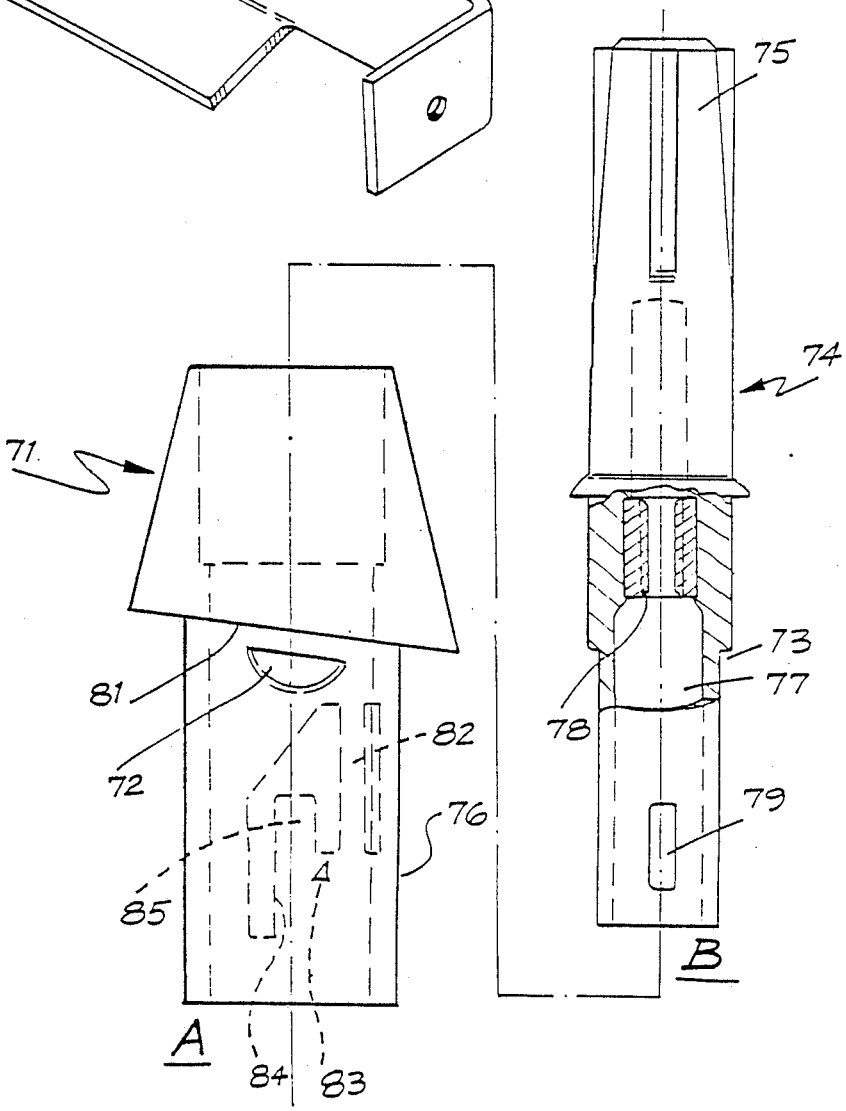
FIG. 2 illustrates a second locking means being comprised of components A and B.
Figure 3:
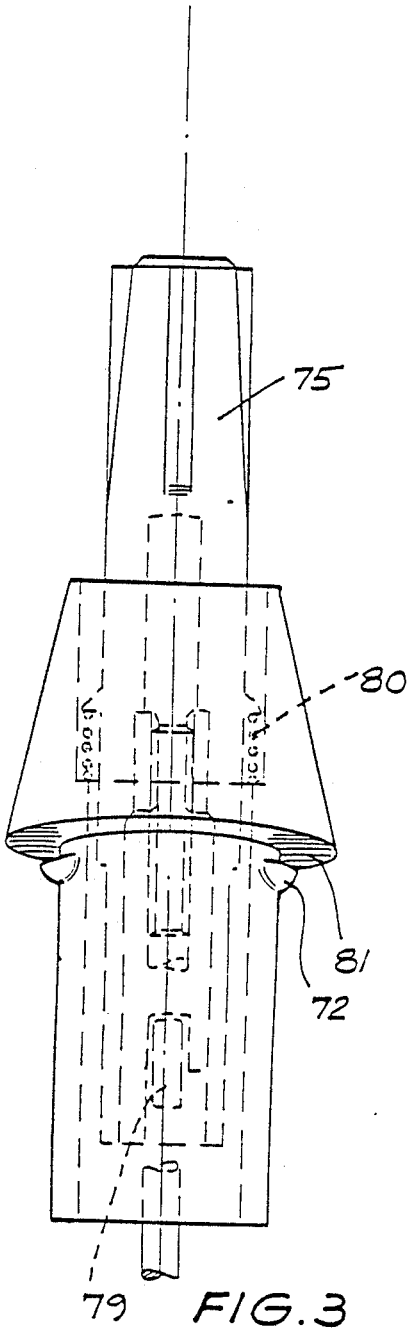
FIG. 3 illustrates the embodiment of FIG. 2 assembled and placed on an existing locking spindle.

The illustrations of FIG. 2 and FIG. 3, are similar to that of FIGS. 1 and 4, however a single outer sleeve 71 is utilised which has locking lugs 72. Outer sleeve 71 also has a tail 76. The spindle 74 has a tapered upper portion 75 and a lower tail portion 73. Downwardly extending spindle tail portion 73 has an internal hollow section 77 and threaded insert 78. Tail portion 73 also has the spigot member 79 similar to spigot member 20 on the inner sleeve 15 of FIGS. 1 and 4. The assembled view, as illustrated in FIG. 3 operates in the following fashion:

The spindle 74 is assembled with the outer sleeve 71 with a compression spring 80. The outer sleeve 71 is placed into a door panel of a conventional motor vehicle and the door panel is locked relative to the outer sleeve 71 by means of the locking lugs 72 and mating with the surface 81 which forms a flange on the outer sleeve 71.

In operation, spindle 74 is pushed down to lock the door which in turn moves the door lock rod 21 to which it is connected in a downward direction. Further pushing in the downward direction forces the spigot 79 to pass through channel 82 where it clears the bottom of the locking lug 83. The spindle 74 is then turned clockwise a quarter of a turn until the stop 84 is reached. Compression provided by the spring 80 lifts the spindle 74 back in the upward direction so that the spigots 79 engage the slots 85 which are thereby locked into position. The only way to open the lock containing the apparatus of FIGS. 3 and 2 is to open the door from the inside.

By virtue of the locking engagement of the spindle 74 with outer sleeve 71 forced entry is prevented. Attempting to open or move this door lock by placing a wire down the door to activate the lock rod independently will not be successful by virtue of the lock between the spindle 74 and outer sleeve 71.

Figure 5:
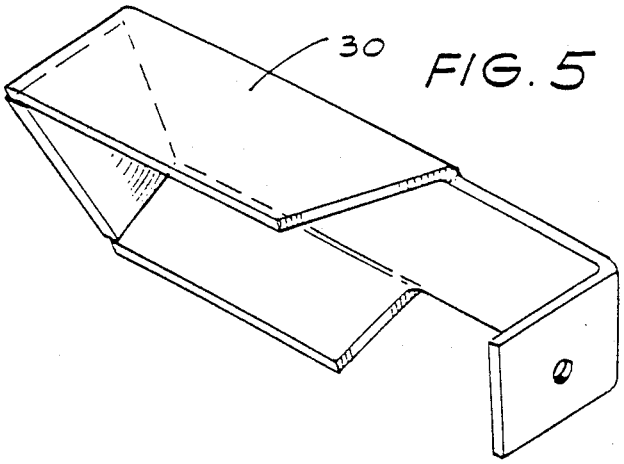
FIG. 5 illustrates a door lock protector to be used with said components of FIGS. 1 and 2 to complete the security system.

The apparatus is intended for use in the following fashion:

In a conventional car having four doors, driver side front door is fitted with locks as described and illustrated in FIGS. 1 and 4, a locking mechanism guard 30 being placed over the locking mechanism in accordance with the apparatus of FIG. 5. The remaining three doors are fitted out with the apparatus of FIGS. 2 and 3. Alternatively the apparatus of FIGS. 2 and 3 can be fitted to both front doors (by fitting of an extra guard).

The foregoing describes some embodiments of the present invention and modifications made by those skilled in the art can be made thereto without departing from the scope of the present invention.

I claim:

1. A security device for fitting to a door frame or sill and which is operable between a locked and unlocked position so that the door can be locked and unlocked characterized in that the device comprises:

a first sleeve member fixedly and non-rotatably attached to said door frame or sill;

a second sleeve member which fits concentrically and rotatably within said first sleeve member;

a spindle member which fits concentrically and rotatably within said first and said second sleeve members and which is operably connected with a locking component on or within said door;

bias means located within said first sleeve for braising the second sleeve member upwardly;

rotationally engageable engaging means between the first and second sleeve members;

wherein when said device is to be set in said locked position, said second sleeve is pushed downwardly and rotatably within said first sleeve against said bias means such that said second sleeve releasably engages said first sleeve via said engaging means and said spindle is pushed downwardly so that said locking component locks said door; and wherein when said device is to be set in said unlocked position, said second sleeve member is pushed first downwardly, thence rotated such that said engaging means disengages from said first sleeve member, said bias means forcing said second sleeve member in an upward direction such that it engages said spindle to force said spindle upwards, thereby causing said locking component to be placed in an unlocked mode.

2. A security device according to claim 1, wherein the said first sleeve member releasably engages the said second sleeve member by movement against the bias means.

3. A security device according to claim 2, wherein the said first sleeve member has at least one slot into which at least one spigot on the said second sleeve member fits, allowing downward and rotational movement of the second sleeve member relative to said first sleeve member thereby allowing releasable engagement between said members.

4. A security device according to claim 3, wherein the said at least one slot is formed in the shape of a "J".

5. A security device according to claim 4, wherein the door is unlocked by application of downward pressure and rotation applied to said second sleeve and comprising means for causing said spindle to move upwardly when said bias acts against said second sleeve member.

6. A security device for fitting to a door frame or sill and which is operable between a locked and unlocked position so that the door can be locked characterized in that the device comprises:

a sleeve member fixedly and non-rotatably attached to said door frame or sill;

a spindle member which fits concentrically and rotatably within said first sleeve member and which is operably connected with a locking component on or within said door;

a spring for biasing the spindle upwardly;

rotatably engageable engaging means between the spindle and sleeve;

wherein when said device is to be placed in a locked mode, said spindle is pushed downwardly and rotatably in one direction within said sleeve against the spring bias so that engaging means on said spindle releasably engages said sleeve so that said locking component locks said door; and wherein, when said device is to be placed in an unlocked mode, said spindle is pushed downward and rotated in the opposite direction so that said engaging means disengages from said sleeve, said bias thereby urging said spindle in an upward direction such that said locking component unlocks said door.

7. A security device according to any one of the preceding claims wherein the said bias is a helical spring.

8. A security device according to claim 7, wherein the said spindles and sleeves which rotate have gripping surfaces.

9. A security device according to claim 6, wherein the sleeve member comprises at least one slot to receive at least one spigot on the spindle member.

10. A security device according to claim 9, wherein the spindle is elongated relative to the first sleeve member.

* * * * *